US005894271A

United States Patent [19]

Cleveland et al.

[11] Patent Number: 5,894,271

[45] Date of Patent: Apr. 13, 1999

[54] PRIVATE ALERT SYSTEM FOR MUSCLE FLEXING REGIMEN

[76] Inventors: Dianna L. Cleveland; Lee Namisniak, both of 22592 Le Dana, Mission Viejo, Calif. 92691

[21] Appl. No.: 08/907,440

[22] Filed: Aug. 8, 1997

[51] Int. Cl.[6] ..... G08B 6/00; A63B 69/00

[52] U.S. Cl. ..... 340/407.2; 340/309.15; 340/321; 340/573; 340/693; 368/109; 368/276; 434/247; 434/433; 482/3; 482/148

[58] Field of Search ..... 340/407.1, 407.2, 340/693, 573, 309.15, 321; 368/109, 276; 434/247, 433; 482/3, 148

[56] References Cited

U.S. PATENT DOCUMENTS

| | | | |
|---|---|---|---|
| 3,929,335 | 12/1975 | Malick | 482/8 |
| 3,973,251 | 8/1976 | Stephans | 340/309.15 |
| 3,998,209 | 12/1976 | Macvaugh | 128/848 |
| 4,007,733 | 2/1977 | Celeste et al. | 600/594 |
| 4,237,449 | 12/1980 | Zibell | 340/407.1 |
| 4,396,904 | 8/1983 | Hanaoka | 340/309.15 |
| 4,456,387 | 6/1984 | Igarashi | 368/230 |
| 4,801,921 | 1/1989 | Zigenfus | 340/573 |
| 4,931,765 | 6/1990 | Rollins et al. | 340/407.1 |
| 5,089,998 | 2/1992 | Rund | 368/72 |
| 5,113,176 | 5/1992 | Harris | 340/573 |
| 5,361,241 | 11/1994 | Ferrara et al. | 368/281 |
| 5,554,971 | 9/1996 | Foster | 340/825.46 |
| 5,578,065 | 11/1996 | Hattori et al. | 607/46 |

*Primary Examiner*—Glen Swann
*Attorney, Agent, or Firm*—Price, Gess & Ubell

[57] ABSTRACT

A wafer-like alert unit is disclosed which is affixed to a body surface in a private and discrete manner and provides a private or silent stimulus such as a vibrational signal to the user at selected time intervals to remind the user to flex adjacent muscle groups or to perform isometric exercise. The alert unit is designed to be worn imperceptibly to the public and provide a private and discrete way to maintain an exercise regimen without any wires or bulky control boxes. The alert unit is mounted directly to the body using adhesive or alternatively fitted in a self-adhesive pouch or pocket which is then secured to the body. The alert unit may also be inserted into a fabric pouch that is sewn into an undergarment which is then worn in the normal manner. The alert unit includes a power source such as a battery, a motor which creates a vibrational signal, a power switch, a timer, and means for inputting variable interval settings to allow the user to tailor his or her exercise regimen as needed. At selected time intervals the alert unit sends a vibrational signal to the adjacent body surface, which reminds the user to flex the muscles for a given number of repetitions. Several alert units can be combined into a system in which different body surface are exercised at different intervals or different times.

12 Claims, 1 Drawing Sheet

PRIVATE ALERT SYSTEM FOR MUSCLE FLEXING REGIMEN

BACKGROUND OF THE INVENTION

1. Field of the Invention

The present invention relates generally to physical fitness training, and specifically to a device or plurality of independent devices affixed to selected body parts for privately and discretely signaling to a user at predetermined intervals to flex or contract the muscles at the selected body part for the purposes of improving or maintaining muscle tone and strength.

2. Description of Related Art

One's physical fitness and appearance are of great concern to most of the population. A person's physical appearance influences the style of clothing one wears, one's physical activities, affects one's confidence and mental outlook. To improve one's physical appearance through weight loss, many turn to exercise. Often a person's appearance and the desire to improve one's physical strength or stamina can be to some a source of embarrassment or modesty, and those who are embarrassed may forego exercising rather than exercise in public. This is one reason for the proliferation of home exercise machines, that is, the idea that one can exercise in one's home without being subjected to the view of others.

It has been shown that one way to improve one's fitness and physical appearance is through a consistent exercise regimen along with a proper diet. While most people can maintain a new diet program without significant disruption of their daily routine it is very difficult to initiate or maintain an exercise regimen without significantly rearranging one's daily schedule. One must also have the discipline to execute and maintain a fitness regimen, which for most people is difficult. For this reason, many people quit most exercise programs before they have a chance to be effective or have difficulty finding or making the time to exercise regularly. Without some consistent form of exercise, one can suffer from weak or lack of overall body muscle tone and strength. Other factors such as age, stress, improper posture, pregnancy, childbirth, disability or simply a sedentary lifestyle usually contribute to less than desirable body muscle tone. Poor muscle strength can inhibit one from beginning a fitness regimen. Furthermore, a lower body ratio of muscle-to-fat can slow the body's metabolism and reduce its aptitude for burning excess fat. Conversely, a higher ratio of muscle-to-fat can increase the body's ability to burn excess fat and provide more energy for exercising. Therefore, there are many benefits to exercise.

One way to improve or maintain muscle tone and thereby improve one's appearance and aptitude for physical fitness is through muscle strengthening exercises and weight training. Typically, one must set aside time for this form of exercise in sessions of twenty to forty minutes two or three times per week in order to achieve results. Additionally, one must usually use special equipment such as machines or weights specifically designed for this purpose. Hence, one is again faced with the problem of rearranging one's schedule in order to maintain a regimen. Another less strenuous way to improve or maintain muscle tone is through muscle contraction and flexing exercises, also known as isometric or isotonic exercises. Isometric exercises using one's own body for resistance has proven to be very effective. Isometric exercise and muscle flexing also has the added benefit in that one can perform this activity while at work, school, or while traveling without disrupting one's ordinary schedule.

Repeated contraction and flexion of varied and multiple muscle groups several times throughout the day, all day, can significantly increase the body's overall muscle tone and improve the elasticity of the muscles and skin, particularly for muscle groupS that are typical problem areas for most people such as shoulders, back, abdomen, and buttocks. This activity can be done without the notice of others, and therefore provides an advantageously discreet method for improving one's appearance and aptitude for fitness.

The difficulty in maintaining a consistent flexing schedule is that people become preoccupied with events and occurrences that make-up each day, and most people do not have the focus or memory to maintain regimen throughout the day. Telephone calls, meetings, various interruptions, and so on prevent a person from keeping a regular flexing schedule throughout the day. Moreover, people simply tend to forget to perform the flexing exercises, and after a while the program is relinquished.

There also exists a need for muscle flexion and exercise by patients recovering from injury or surgery. Often times a physician will recommend to his patient in a cast or otherwise immobilized that various extremities require flexing so that the muscles do not atrophy. This admonition is usually ignored or not heeded because the patient forgets to exercise the muscles throughout the day. Some patients employ expensive physical therapists to ensure that the muscle groups in question are exercised at regular intervals throughout the recovery period.

What the art needs is a device which will privately and unobtrusively signal a person to flex particular muscle groups at pre-selected intervals during the day, every day. A consistent signal would also serve to establish a "habit" of flexing.

Some have proposed alerts which can serve some of the objects of the present invention, although there are still serious drawbacks to the devices of the art. Most notably, Zigenfus, U.S. Pat. No. 4,801,921 proposes a control unit which secures to a user's belt, and includes leads which attach to the stomach area. Signals are sent from the control unit to the leads to remind the user to flex the stomach muscles. The disadvantages of the Zigenfus reference include the requirement of a control device which is bulky and cannot be concealed easily, thereby removing an element of privacy from the user. Others would likely be aware that the user was wearing the device, which would discourage many people from using it. Also, the Zigenfus device, because of its structural arrangement, is limited to one muscle group per wire set. Use of more than two wires as shown would not be practical since it would lead to problems such as tangling, bulkiness, discomfort, and less privacy. Additional wires would also affect one's choice of apparel in order to conceal the wires from a casual observer. Moreover, location of the alerts on the body is limited in the Zigenfus device. The practical application of the device is limited to regions adjacent the control unit, such as the stomach or pelvic regions because of the length of wire necessary to reach other areas. As a result, other important muscle groups such as the calves, arms, neck, and so forth cannot be "alerted" discretely by the Zigenfus device.

The prior art lacks a device and system for discretely, privately, and periodically signaling a user to flex a muscle group and which does not suffer from the drawbacks identified above.

OBJECTS AND SUMMARY OF THE INVENTION

It is an object of the present invention to provide a self-contained private, unobtrusive, wireless alert unit which adheres to a localized body location and signals the user periodically to exercise or flex an adjacent muscle group.

It is another object of the present invention to provide a light-weight alert unit which can be worn completely beneath one's outer clothing and remain mostly invisible to the public.

It is yet another object of the present invention to provide an effective means for securing the alert unit comfortably to the body of the user.

It is still another object of the present invention to provide a system of alerts whereby different individual alerts are combined to signal the user at different times to exercise different local muscle groups.

The foregoing objects and the general purpose of this invention are achieved by a small, self-contained thin wafer comprising a battery for power, an on/off switch, a small motor which produces a signal such as a vibration that can be transmitted to an adjacent body surface, and circuitry including a micro-controller, a timer and a rate controller for causing the motor to initiate and terminate at designated time periods set by the user. A preferred embodiment of the unit is approximately the size of a half-dollar and a thickness of less than one-half of one inch. The alert unit can be attached to the body by applying a layer of adhesive directly to the alert unit and then pressing it on the body. Another preferred embodiment includes a self-contained acrylate adhesive strip of material similar to that used in adhesive bandages with a pouch thereon specifically designed to receive and house the alert unit. Another embodiment includes a pouch made from a woven or fabric material that can be sewn to an article of clothing such as an undergarment. The alert unit can be removed from the pouch so the garment can be laundered.

BRIEF DESCRIPTION OF THE DRAWINGS

The exact nature of this invention, as well as its objects and advantages, will become readily apparent upon reference to the following detailed description when considered in conjunction with the accompanying drawings, in which like reference numerals designate like parts throughout the figures thereof, and wherein.

DETAILED DESCRIPTION OF THE PREFERRED EMBODIMENTS

The following description is provided to enable any person skilled in the art to make and use the invention and sets forth the best modes contemplated by the inventors of carrying out their invention. Various modifications, however, will remain readily apparent to those skilled in the art, since the general principles of the present invention have been defined herein specifically to provide a private adjustable alert unit and system comprising a plurality of independent alerts which signal a user periodically to exercise a designated muscle group.

Figure 1:
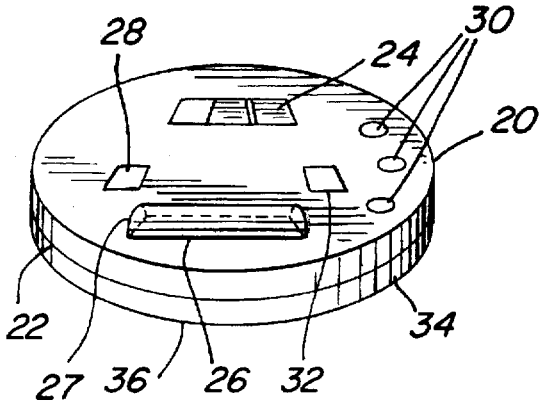
FIG. 1 shows a perspective view of the alert unit of the present invention.

A preferred embodiment of the alert unit 20 is shown generally in FIG. 1, which depicts a thin self-contained wafer comprising a disk 22 of approximately one quarter to three-eighths inch thickness and a diameter of approximately one and one-half inches. Located on or within the disk 20 is an on/off switch 24, a motor 26, a controller circuit 28, a plurality of rate indicator displays 30, a rate input button 32, and a battery 34. The disk 22 operates as a programmable alert where the user turns the unit on using the on/off switch 24, and then by pressing the rate input button 32 the frequency of activation is shown successively in one of the rate indicator displays 30. In this manner, the alert activation frequency can be adjusted from, for example, ten to twenty to thirty minute intervals. The controller circuit 28 includes a timer chip (not shown) and connects the battery 34 to the motor 26. The motor 26 emits a vibration, preferably silent, which is transmitted to the user at the adjacent body location such as the back, stomach, calf, and so forth.

In order to achieve a thinner wafer, the motor 26 and the battery 34 can be placed within the circuit board (not shown) in spaces cut specifically for the components versus placement on top of the circuit board. The alert unit 20 is preferably enclosed in a housing comprising a mold of liquid plastic. The motor 26 is enclosed in a tube or sleeve 27 creating an air bubble for movement. The entire alert unit is then placed in a small mold, and the mold filled with the liquid plastic which dries to form a sealed, smooth disk that is thinner toward its outside edge. The plastic could be chosen to yield the desired flexibility and softness, which are important considerations when an article is placed in contact with or immediately adjacent a person's skin. All that is exposed through the plastic is the on/off switch 24 and the rate input button 32. The plastic cover would serve to protect and insulate the electronics from dirt, dust, moisture, and so forth thereby prolonging its projected life. It also protects the components from moisture. In conjunction with a moisture resistant self-adhesive pouch, the alert unit can be worn for two or more days and in the shower or bath. When the battery 34 becomes exhausted, the entire unit is disposed of. The unit can also be enclosed in a standard housing with a battery compartment providing access for replacing the battery.

Figure 2:
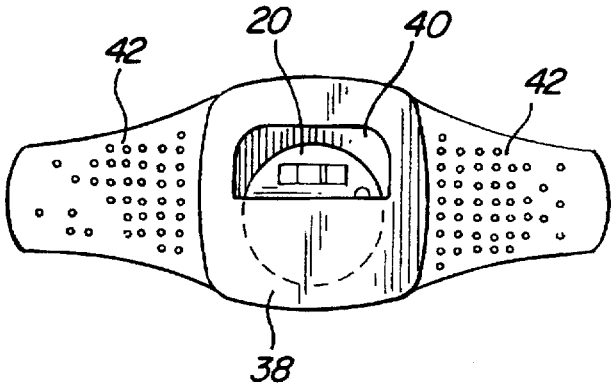
FIG. 2 shows a plan view of a pouch of a preferred embodiment.

To affix the alert unit 20 to the user's body, several attachment means are envisioned. One method is to have a layer of acrylate adhesive applied directly to the surface of the disk 22, so that the disk 20 could be directly applied to the user. However, for greater versatility and comfort, a pouch 38 or pocket with an adhesive backing can be used whereby the alert unit 20 is received in a slot 40 in the pouch (see FIG. 2). A sheet of pouches 38 would be provided with the alert unit, a new pouch being used each time the unit is removed and replaced on the body. The pouch 38 preferably has an adhesive backing and adhesive flaps 42 and is thin enough that the alert unit is maintained in an operable relationship with the adjacent body surface, i.e., that a vibration signal is transmitted with sufficient strength that a person not expecting the signal will still perceive it.

The adhesive used for direct contact with the skin is preferably a liquid acrylic adhesive similar to that manufactured by Minnesota Mining and Manufacturing, also known as 3M. The pouch 38 can also be made from acrylate adhesive tape mounted to a larger strip of tape which is then placed on the body. Also, a larger adhesive patch can be placed over the alert unit affixing it directly to the body.

Figure 3:
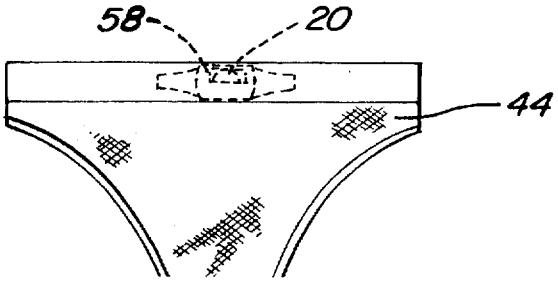
FIG. 3 shows an undergarment with a pouch designed to receive and house the unit sewn therein.

Another preferred embodiment is depicted in FIG. 3 wherein a fabric pouch 58 may be sewn into an undergarment 44. Here, the taughtness of the garment 44 positions the alert unit 20 adjacent to the body surface in order to maintain an operable relationship.

Figure 4:
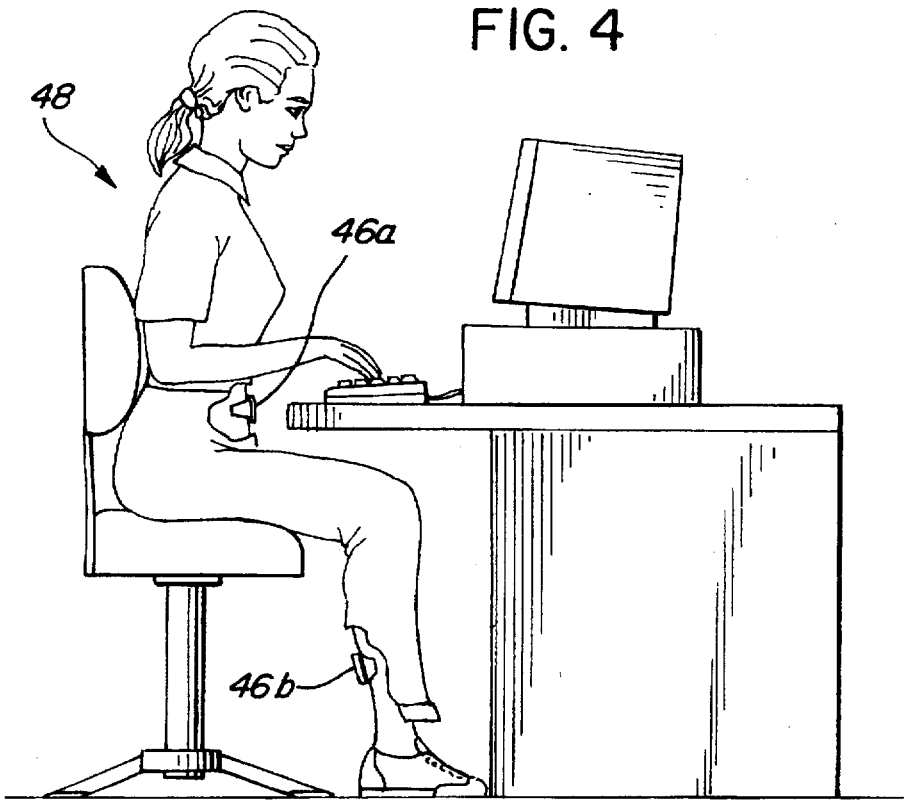
FIG. 4 shows a user with two alert units affixed adjacent to two different body surfaces.

With the alert unit 20 securely placed adjacent one or more body surfaces 46a,46b, the user 48 can improve his or her muscle tone at selected locations tailored to each user. For example, a person trying to strengthen muscles in his abdomen and calves can place the alert unit and pouch directly on these areas 46a,46b (see FIG. 4). The alerts are set for ten minute intervals, for example, such that every ten minutes the user will receive a vibrational signal at her calves 46b and stomach 46a via the alert units. When multiple alerts are used, the timing can be staggered so that different muscle groups do not overlap. Once the alert activates, the user would perform by flexing or tightening those muscles in the adjacent muscle group a prescribed number of repetitions or for the duration of the vibration.

The alert could also be placed on the user's back to remind the user to check his posture for those who suffer from posture related discomfort. Women wishing to counteract the effects of childbirth or to reduce bladder incontinence could place the alert unit near the front upper thigh region to remind the user to perform vaginal muscle contractions known as Kegel exercises throughout the day.

Another beneficial use of the present invention utilizes a plurality of alert units located at different regions of the body, such as a single unit on the upper body, the mid torso, and the legs. The alert units each signal the user to perform a prescribed series of isometric or various muscle exercises in the region. For example, when the upper body alert unit activates, the user could commence isometric exercises of the facial muscles in a specific manner for a prescribed number of repetitions. The next time the alert unit activates, possibly thirty minutes later, the user could commence isometric exercises of the shoulder muscles. Advancing along, the next time the alert unit activates, another thirty minutes later, the user could commence exercises of the next muscles, and so on. Then, when the mid-torso alert unit activates, the user would know to begin the succession of prescribed exercises for the region of the body such as the back, stomach and buttocks muscles. Similarly, the user would perform a series of exercises for various leg muscles in response to the leg alert unit. The system of alert units would be set to activate at different times so that the regimens would not overlap. By the end of a given day, the user would have performed one session of isometric exercise for each of the major muscle groups in the body. Because the exercises are done in a prescribed succession with the intervals spaced throughout the day using the alert unit, the user will have been able to accomplish this regimen with little or no disruption to his or her normal daily activities. The above-described method could be used in conjunction with another alert unit designated for a trouble area. That is, in addition to the three regional alert units, a fourth alert unit could be located on the abdomen and set for an increased frequency, such as every ten minutes to prompt the user to perform the less strenuous exercise of flexing, contraction or stretching. The user would exercise his or her abdomen more frequently while maintaining a consistent daily exercise regimen for the other regions.

Over time, the user will automatically establish new habits of flexing his muscles even when not prompted or reminded, resulting in firmer muscles, improved posture and appearance, and improved aptitude for fitness. The present invention allows the user to select a combination of body parts for exercise, or just a single body part. The silent nature of the present invention makes it convenient for use at home, work or school. Others will not be aware of its presence. The system of reminders provides an on-the-go muscle toning regimen that can be easily maintained all day and every day.

It is within the scope of the present invention to provide other stimuli besides vibration in order to signal the user. A soft beep could be used where, for example, one typically worked alone or where the user was not concerned with others knowing of its presence. Similarly, an electric impulse could be transmitted to signal the user. Also, the period of the impulses is preferably regular, i.e. evenly spaced, but the intervals could be irregular, or increasing or decreasing in nature.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

Once electronic technology advances and permits smaller and less expensive components, it is within the scope of the current invention to provide a completely self-contained, self-adhesive disposable patch that houses the electronic components directly. The cost of the components would have to be low enough to justify disposal of the patch and using a new one each day.

What is claimed is:

1. A self-contained exercise alert unit comprising:

A thin disk having means for providing a private stimulus at spaced intervals; and means for securing said disk to a body surface in an area of a muscle group to be exercised.

2. A self-contained exercise alert unit comprising:

a thin disk having means for providing a private stimulus to an adjacent body surface at chronologically spaced intervals; and means for securing the disk in an operable relationship next to said body surface.

3. The self-contained exercise alert unit of claim 2 wherein said stimulus is a silent vibration signal.

4. The self-contained exercise alert unit of claim 2 wherein said chronologically spaced intervals are regular.

5. The self-contained exercise alert unit of claim 2 wherein a duration of said chronologically spaced intervals is selected by a user.

6. The self-contained exercise alert unit of claim 2 wherein said means for securing the disk in an operable relationship next to said body surface comprises an adhesive surface on said disk such that said wafer is affixed directly to said body surface.

7. The self-contained exercise alert unit of claim 2 wherein said means for securing the disk in an operable relationship next to said body surface comprises a pouch for receiving said disk therein, said pouch having an adhesive surface affixing said pouch directly to said body surface.

8. The self-contained exercise alert unit of claim 2 wherein said means for securing the disk in an operable relationship with said body surface comprises a pouch for receiving said disk, said pouch being sewn to an undergarment of a user such that said disk is disposed adjacent said body surface.

9. The self-contained exercise alert unit of claim 2 wherein said means for providing a stimulus comprises a battery, a motor, means for inputting a chronologically spaced interval, a timer, and an on/off switch.

10. A system for reminding a user to flex or contract isolated and separate muscle groups as part of an exercise regimen comprising a plurality of independent alert units disposed on a body surface adjacent each separate muscle group to be flexed or contracted, said alert units each comprising:

means for generating a silent stimulus at chronologically spaced intervals to be received by the adjacent body surface; and means for maintaining said alert unit in operable relationship with said body surface.

11. The system of claim 10 wherein said means for generating a stimulus with said alert units is set by a user to generate its stimulus at times which may be different from each other.

12. The system of claim 10 where said body surface is centralized with respect to said muscle group.

* * * * *